United States Patent [19]

Movshovich et al.

[11] 4,084,400

[45] Apr. 18, 1978

[54] METHOD OF MAKING SELF-TWISTED FIBROUS PRODUCT FROM AT LEAST TWO STRANDS

[76] Inventors: Pavel Mikhailovich Movshovich, Pechatnikov pereulok, 3, kv. 8, Moscow; Viktor Pavlovich Khavkin, ulitsa Vatutina, 11, kv. 4, Moskovskaya oblast, Khimki; Gennady Konstantinovich Maximov, Kaspiiskaya ulitsa, 20, korpus 3, kv. 137, Moscow; Lev Nikolaevich Ivanov, Kotelnicheskaya naberezhnaya, 25/8, kv. 74, Moscow; Natalya Borisovna Babushkina, Chasovaya ulitsa, 5b, kv. 15, Moscow; Vasily Ivanovich Kulikov, Varshavskoe shosse, 18, korpus 3, kv. 412, Moscow; Boris Semenovich Shkrabov, ulitsa Udaltsova, 73a, kv. 34, Moscow; Sergei Vladimirovich Nezelenov, Kineshemskoe shosse, 8a, kv. 6, Kostroma; Gennady Nikolaevich Shutov, ulitsa Sovetskaya, 119, kv. 101, Kostroma; Leonid Nikiforovich Tsygulev, Prospekt textilschikov, 94a, kv. 103, Kostroma; Vadim Sergeevich Ilin, ulitsa 8 Okruzhnaya, 11, kv. 11, Kostroma, all of U.S.S.R.

[21] Appl. No.: 715,167

[22] Filed: Aug. 17, 1976

[51] Int. Cl.[2] ..... D01H 7/90; D02G 3/26

[52] U.S. Cl. ..... 57/156; 57/34 AT

[58] Field of Search ..... 57/34 AT, 156

[56] References Cited

U.S. PATENT DOCUMENTS 3,443,370 5/1969 Walls ..... 57/34 AT

*Primary Examiner*—Richard C. Queisser
*Assistant Examiner*—Charles Gorenstein
*Attorney, Agent, or Firm*—Steinberg & Blake

[57] ABSTRACT

The method of making self-twisted fibrous product from at least two strands relates to spinning. According to the method, each one of a pair of continuously fed strands is acted upon by a torque imparting to the strand an alternating twist. Then the strands are united or plied, so that they untwist about one another, forming the self-twisted product, the strands, as they are thus untwisting about one another, having positively applied thereto a torque in the direction of their untwisting, with the frequency of the variation of the direction of the torque equalling the frequency of the variation of the sense of the twist imparted to each strand. As a result, reliable engagement of the strands is attained without acting thereupon by friction, which minimizes the drift in space of the point of engagement of the strands, whereby the length of the portions devoid of the twist is reduced and stabilized, and the twist of the strands is fully utilized in the twist of the product.

5 Claims, 4 Drawing Figures

METHOD OF MAKING SELF-TWISTED FIBROUS PRODUCT FROM AT LEAST TWO STRANDS

The present invention relates to spinning, and more particularly it relates to methods of making a self-twisted fibrous product, such as yarn or roving, from at least two strands.

There is known a method of making a self-twisted fibrous product from at least two strands. This method resides in applying to each one of the continuously fed strands a torque imparting to the strand an alternating twist. Then the strands are united or plied, so that they untwist about one another, forming the self-twisted product, which is then wound into a package.

The uniting of the strands which have received the alternating twist can be effected with the aid of a rigid frictional clamp, or else, they can be united by free engagement of the strands.

In the first case, there takes place some loss of the elastic deformation of the twisted strand in the clamp itself, prior to the uniting of the strands, and, besides, the presence of the rigid clamp obstructs the free untwisting of the strands. As a result, the degree or intensity of the twist and the strength of the product obtained are impaired, and the factor defining the variation of the length of the portions devoid of the twist is increased.

When the strands are united by free engagement, this engagement of the strands is poorly controllable, and the point of the engagement of the strands exhibits a significant drift in space, which causes a reduced intensity of the twist, asymmetry of the twist pattern and an increased factor defining the variation of the length of the portions devoid of the twist, to say nothing of the strength of the product obtained being impaired.

It is an object of the present invention to provide a method of making a self-twisted fibrous product from at least two strands, wherein the twist of each strand should be utilized to the greatest possible extent in the twist of the product, thus reducing the length of the portions devoid of the twist, increasing the intensity of the final twist and improving the quality of the product obtained.

This and other objects are attained by a method of making a self-twisted fibrous product from at least two strands, comprising the steps of applying to each one of the continuously fed strands a torque imparting to the strand an alternating twist, then uniting the strands so that they untwist about one another, forming the self-twisted product, and winding the product into a package, in which method, in accordance with the present invention, a torque is positively applied to the strands, as they are thus untwisting about one another, in the direction of their untwisting upon one another, the frequency of the variation of this torque equalling the frequency of the variation of the sense of the twist imparted to each strand.

As a result of this positive action upon the strands in the course of their untwisting about one another there is attained a reliable engagement of the strands without exerting any action thereupon by friction, which minimizes the drift in space of the point of the engagement of the strands and thus stabilizes the length of the portions devoid of the twist. Moreover, the action of the torque upon the strands, following their being united and in the course of their untwisting upon one another, promotes more regular untwisting of the strands, i.e. a fuller utilization of the twist imparted to the strands in the twist of the final self-twisted product, whereby the intensity of the twist of the product is increased, the length of the portions devoid of the twist is reduced, and the strength of the product is stepped up.

The invention is further characterized in that, as the strands are untwisting about one another, the torque is applied thereto with a phase shift substantially within $\pm 90°$ with respect to the torque acting upon each strand prior to uniting the strands, which further enhances the strength of the product obtained.

Thus, the herein disclosed method of making a self-twisted product, as compared with the hitherto known method of making a similar product, enables obtaining a product with a higher degree of twist uniformly distributed over the length of the product, with shorter portions devoid of the twist and with a greater strength.

Given hereinbelow is a detailed description of the proposed method of making a self-twisted product from at least two strands, according to the invention, with reference being had to the accompanying drawings, wherein.

Figure 4:
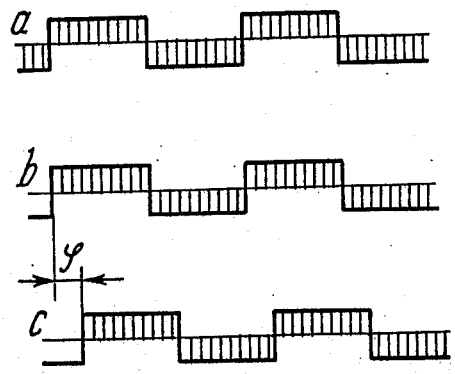

FIG. 4 "*a*", "*b*" shows diagrams illustrating the torques applied to the strands prior to the moment of their being united, according to one embodiment of the invention;

FIG. 4 "*c*" is a diagram illustrating the torque applied to the strands as they are untwisting about one another.

The herein disclosed method of making a self-twisted fibrous product is realized as follows.

Figure 1:
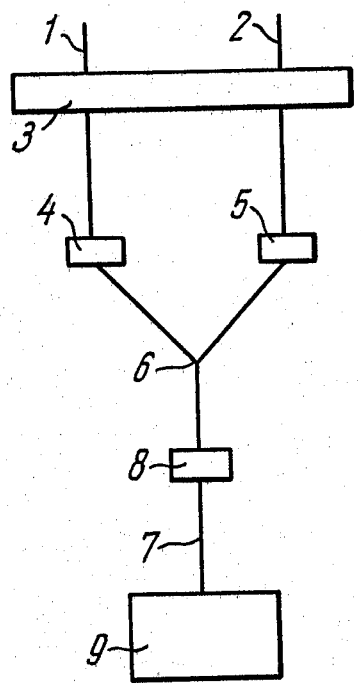
FIG. 1 shows schematically an apparatus for carrying out the method in accordance with the present invention.

Strands 1 and 2 (FIG. 1) of a fibrous material are continuously fed in by a feeding mechanism 3 which can be of any known per se structure suitable for the purpose. Each one of the continuously fed strands 1 and 2 is acted upon by a torque imparting to this strand an alternating twist, i.e., a twist of the alternating sense. The torque can be created by any suitable twist-imparting member, e.g. a swirl chamber 4 for the strand 1 and a swirl chamber 5 for the strand 2, the law of the variation of the torque applied to the strands 1 and 2 in the swirl chambers 4 and 5 being any. Then the strands 1 and 2, as they issue from the chambers 4 and 5, are united or plied at a point 6, and these strands 1 and 2 untwist, at the same time twisting about each other and forming the self-twisted product 7. As the strands 1 and 2 are thus untwisting about each other, they are positively acted upon by a torque in the direction of their untwisting about each other, the frequency of the variation of this last-mentioned torque equalling the frequency of the variation of the direction or sense of the twist that has been imparted to each one of the strands 1 and 2. This positive action of the torque upon the strands 1 and 2, untwisting about each other, is effected by any suitable known per se reversible twisting means 8, e.g. a swirl chamber. Upon leaving the twisting means 8, the product 7 is wound into a package 9.

Figure 2:
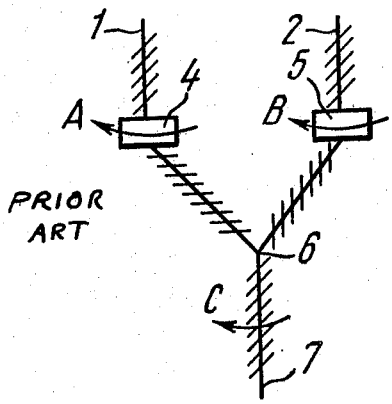
FIG. 2 illustrates one of the stages of the process of forming the product, with the twists shown schematically.
Figure 3:
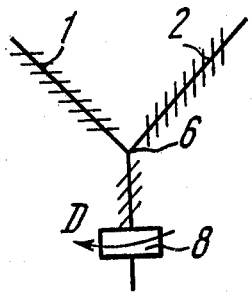
FIG. 3 shows same as FIG. 2, but with the positive action of the torque upon the strands in the process of their untwisting.

FIG. 2 of the appended drawings illustrates schematically the twists imparted to the strands 1 and 2 and to the product 7 in the absence of the action of the positive torque upon the product 7. It can be seen in this drawing that the direction of the twisting of the strands 1 and 2, caused by the action thereupon of the torques in the swirl chambers 4 and 5, of which the direction is indicated, respectively, by arrows A and B, coincides with the direction of the unitwisting of these strands 1 and 2, following their being united at the point 6, indicated by arrow C. The positive torque created within the reversible twisting means 8 (FIG. 3) has a direction indicated with arrow D and coincides with that of the untwisting of the strands 1 and 2 indicated with arrow C (FIG. 2). Thus, the strands 1 and 2 are positively untwisted about one another within the means 8 and thus reliably engage each other at the point 6 without any friction clamp.

Furthermore, according to a preferred embodiment of the present invention, the positive torque is applied within the means 8 to the strands 1 and 2 untwisting about each other with a phase shift substantially within $\pm 90°$ with respect to the torques acting upon each of the strands 1 and 2 prior to their being united.

One of the possible embodiments of the present invention is illustrated in FIG. 4 where "*a*" is the time-related diagram of the value of the torque applied to the strand 1, "*b*" is the time-related diagram of the value of the torque applied to the strand 2, "*c*" is the time-related diagram of the value of the torque applied to the product 7. As it can be seen from FIG. 4, the direction of the torque applied to the product generally coincides with the direction of the torques applied to the respective strands, but can be phase-shifted by $\pm \phi$ with respect to these last-mentioned torques. The positive action of the torque upon the product, irrespectively of the actual technique of imparting the alternating twist to each one of the strands 1 and 2, coincides within each semi-cycle with the direction of the untwisting of the strands. Furthermore, within each semi-cycle the frequency of the variation of the positive torque coincides with the frequency of the variation of the sense of the twist of each strand.

What is claimed is:

1. A method of making a self-twisted fibrous product from at least two strands, comprising the steps of: continuously feeding two strands, applying simultaneously and identically to each one of said continuously fed strands a torque imparting to said strands an alternating twist, with each strand having between successive portions to which alternating twist is applied a portion which is devoid of twist; then uniting said strands at a free point of engagement therebetween without exerting any frictional action on said strands for plying said strands together while they untwist about one another during travel beyond said point of engagement and to form only from said plied strands the product which is subsequently wound into a package; positively applying to said plied strands, as they are untwisting about one another, during travel beyond said point of engagement, a final torque coinciding with the direction of their untwisting about one another, with the frequency of the variation of the direction of said final torque equalling the frequency of the variation of the sense of the twist imparted to each one of said strands prior to said point of engagement, said final torque being superimposed on the untwisting plied strands travelling beyond said point of engagement in a manner which intensifies the untwisting of the plied strands about one another while reducing the length of the portions of said strands which are devoid of twist.

2. A method as claimed in claim 1, wherein the final torque applied to said strands, as they are untwisting about one another, is phase-shifted substantially within $\pm 90°$ with respect to the torques acting upon each one of said strands prior to said strands being united, thereby resulting in a coincidence between the direction of the final torque and the direction of untwisting of the plied strands about one another.

3. A method as claimed in claim 1, wherein the extent, duration and length of application of torque to said strands before and after said point of engagement in one direction equals the extent, duration, and length of application of torque thereto in the opposite direction.

4. A method as claimed in claim 1, wherein within each increment when torque is imparted to each strand prior to said point of engagement of said strands in a given direction, said final torque is applied to said plied strands also in said given direction for a time equal to more than one-half of said increment.

5. A method as claimed in claim 4, wherein within an immediately subsequent increment when torque is applied to each of said continuously fed strands prior to said point of engagement thereof in a direction opposite to said given direction, said final torque continues to be applied to the plied strands in said given direction during an initial part of said subsequent increment which is substantially less than one-half of said subsequent increment.

* * * * *